US007444829B2

(12) United States Patent
Mori et al.

(10) Patent No.: US 7,444,829 B2
(45) Date of Patent: Nov. 4, 2008

(54) AUTOMATIC ICE MAKING MACHINE

(75) Inventors: Kazuhiro Mori, Toyoake (JP); Akihiko Hirano, Toyoake (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 315 days.

(21) Appl. No.: 10/570,582

(22) PCT Filed: Dec. 6, 2004

(86) PCT No.: PCT/JP2004/018530

§ 371 (c)(1),
(2), (4) Date: Mar. 1, 2006

(87) PCT Pub. No.: WO2005/061974

PCT Pub. Date: Jul. 7, 2005

(65) Prior Publication Data

US 2006/0288726 A1 Dec. 28, 2006

(30) Foreign Application Priority Data

Dec. 19, 2003 (JP) ..... 2003-423384
Dec. 19, 2003 (JP) ..... 2003-423385

(51) Int. Cl.
*F25C 5/08* (2006.01)

(52) U.S. Cl. ..... 62/351; 249/78

(58) Field of Classification Search ..... 62/347, 62/351; 219/385–387, 436–438; 249/78
See application file for complete search history.

(56) References Cited

U.S. PATENT DOCUMENTS 1,852,064 A * 4/1932 Rosenberg ..... 62/350
1,977,608 A * 10/1934 Blystone ..... 62/350
3,220,205 A * 11/1965 Breeding ..... 62/73
3,952,539 A * 4/1976 Hanson et al. ..... 62/351
5,582,754 A * 12/1996 Smith et al. ..... 219/438

FOREIGN PATENT DOCUMENTS

JP 10-2644 1/1998
JP 2003-242732 8/2003

* cited by examiner

*Primary Examiner*—William E Tapolcai
(74) *Attorney, Agent, or Firm*—William L. Androlia; H. Henry Koda

(57) ABSTRACT

The peel off between an ice making plate and an insulating layer or between the insulating layer and heating means is prevented so that an ice making operation can be performed efficiently. Also, a metal plate is insulated from the heating means reliably.

An evaporation pipe 14 and electric heaters H1 to HN are provided in an ice making member 11. A coolant is circulatingly supplied through the evaporation pipe 14 so as to cool the ice making member 11 and ice making water is supplied to the ice making member 11 so as to form an ice block M during the ice making operation. During the deicing operation, heat is generated in the heaters H1 to HN by applying current so that the ice block M is removed from the ice making member 11 by melting. The ice making member 11, in a state that an insulating layer 12*b* lies between a metal plate 12*a* to which the evaporation pipe 14 is fixed and the heaters H1 to HN, is formed by bonding the metal plate 12*a* with the insulating layer 12*b*, and the insulating layer 12*b* with each of the heaters H1 to HN by thermocompression. Also, in addition to thermocompression bonding, the external outline of the heating means (H1 to HN) may be located inside the insulating layer 12*b*.

2 Claims, 5 Drawing Sheets

(a)

(b)

AUTOMATIC ICE MAKING MACHINE

TECHNICAL FIELD

The present invention relates to an automatic ice making machine which generates heat in heating means by applying current so as to remove an ice block formed in an ice making section.

BACKGROUND ART

An automatic ice making machine for making large volume of ice blocks automatically in which an evaporation pipe is provided in an ice making section led out from a refrigeration system having a compressor, a condenser and the like, is configured so as to form an ice block by supplying ice making water to the ice making section cooled by a coolant supplied circulatingly through the evaporation pipe, thereby dropping and releasing the obtained ice block by separation. The automatic ice making machine, which has an ice making water tank for retaining a required amount of ice making water, is configured so that ice making water in the tank is fed by pressure by a circulating pump to be supplied to the ice making section during the ice making operation, and that ice making water which has not frozen yet is collected in the tank and then fed to the ice making section again. When a detection device detects that the water level in the ice making water tank has reached a preset lower water level as the ice making operation continues, it is determined that the ice making in the ice making section has finished, thereby shifting the ice making operation to the deicing operation. While hot gas discharged from the compressor is supplied to the evaporation pipe by switching a valve of the refrigeration system, water from an external water supply is sprinkled over the ice making section as deicing water, so as to accelerate the melting of the frozen surface with the ice block (for example, see Japanese Examined Utility Model Publication No. Hei 3-17187).

As described above, in the automatic ice making machine which uses both hot gas and deicing water during the deicing operation, the deicing operation becomes longer and the ice making capacity per unit time has limitations. Also, use of deicing water results in increase in water consumption, thereby requiring a higher running cost.

Consequently, by utilizing the technology disclosed in the specification of U.S. patent application Ser. No. 2003-0155467, there have been attempts to shorten the amount of time required for the deicing operation. Specifically, the ice making section is composed of a metal plate and a heater so that an ice block is formed on the heater during the ice making operation and heat is generated in the heater by applying current during the deicing operation, in order to melt the frozen surface between the heater and the ice block thereby removing the ice block from the ice making section for deicing. According to this configuration, the deicing operation becomes shorter and deicing water becomes unnecessary.

DISCLOSURE OF THE INVENTION

Problems to be Solved by the Invention

The ice making section composed of a metal plate and a heater has to prevent an electric current from flowing through the metal plate when applying current through the heater, and therefore an insulating layer is provided between the metal plate and the heater. In this case, in order to provide an insulating layer between the metal plate and the heater, a method of using an adhesive of epoxy resin or the like so as to sandwich resin material between the metal plate and the heater is conceivable. However, in the configuration in which resin material is pasted with an adhesive, the heat effect caused by generating heat in the heater by applying current, degeneration of the adhesive over time, the expansion/contraction of the resin material due to heating/cooling or the like leads to the peeling off between the metal plate and the resin material or between the resin material and the heater. If the insulating layer is thus peeled off from the metal plate or the heater, an air layer is formed therebetween, which means the heater for forming an ice block during the ice making operation becomes more difficult to cool, thereby also causing a decrease in ice making efficiency.

Furthermore, if the metal plate is not fully insulated from the heater, the heat efficiency of the heater decreases when applying current through the heater, and the ice making machine is liable to be damaged.

Accordingly, the present invention has been proposed to solve the above-mentioned problems inherent in the foregoing prior art in a favorable manner, and it is an object of the present invention to provide an automatic ice making machine which can prevent the peel off between an ice making plate and an insulating layer and between the insulating layer and heating means so as to perform an ice making operation efficiently.

Another object of the present invention is to provide an automatic ice making machine in which a metal plate can be insulated from heating means reliably.

Means for Solving the Problems

In order to solve the above-mentioned problems and to achieve the expected objects in a favorable manner, an automatic ice making machine according to the present invention, wherein:

in an automatic ice making machine having an evaporator and electric heating means in an ice making section, configured so that a coolant is circulatingly supplied through the evaporator so as to cool the ice making section and ice making water is supplied to the ice making section so as to form an ice block during the ice making operation while heat is generated in the heating means by applying current so as to remove the ice block from the ice making section by melting during the deicing operation, the ice making section is composed of a metal plate to which the evaporator is fixed, the heating means, and an insulating layer lying between the evaporator and the heating means, and the insulating layer is bonded to each of the metal plate and heating means by thermocompression.

Furthermore, in order to solve the above-mentioned problems and to achieve the expected objects in a favorable manner similarly, an automatic ice making machine according to the present invention, wherein:

in an automatic ice making machine having an evaporator and electric heating means in an ice making section, configured so that a coolant is circulatingly supplied through the evaporator so as to cool the ice making section during the ice making operation and ice making water is supplied to the ice making section so as to form an ice block while heat is generated in the heating means by applying current so as to remove the ice block from the ice making section by melting during the deicing operation, the ice making section is composed of a metal plate to which the evaporator is fixed, the heating means, and an insulating layer lying between the metal plate and the heating means, and the external outline of the heating means is configured so as to be located inside the external outline of the insulating layer.

Effect of the Invention

According to an automatic ice making machine of the present invention, since a metal plate, an insulating layer and each of heating means are laminated by thermocompression bonding without using an adhesive, adhesive degeneration caused by generating heat in the heating means by applying current does not separate the metal plate, the insulating layer and the heating means from each other, thereby cooling the heating means reliably so as to perform a stable ice making operation. Therefore, the heating means can be cooled efficiently during the ice making operation, thereby producing no decrease in ice making efficiency.

Also, according to another automatic ice making machine of the invention of the present application, since a metal plate, an insulating layer and each of heating means are laminated and the external outline of the heating means is located inside the external outline of the insulating layer, the metal plate and the heating means can be reliably prevented from making contact with each other. Therefore, the metal plate can be insulated from the heating means reliably thereby preventing a decrease in heat generation efficiency of the heating means when applying current through the heating means.

BEST MODE FOR CARRYING OUT THE INVENTION

Next, an automatic ice making machine according to the present invention is described by way of a preferred example with reference to the accompanying drawings.

Figure 1:
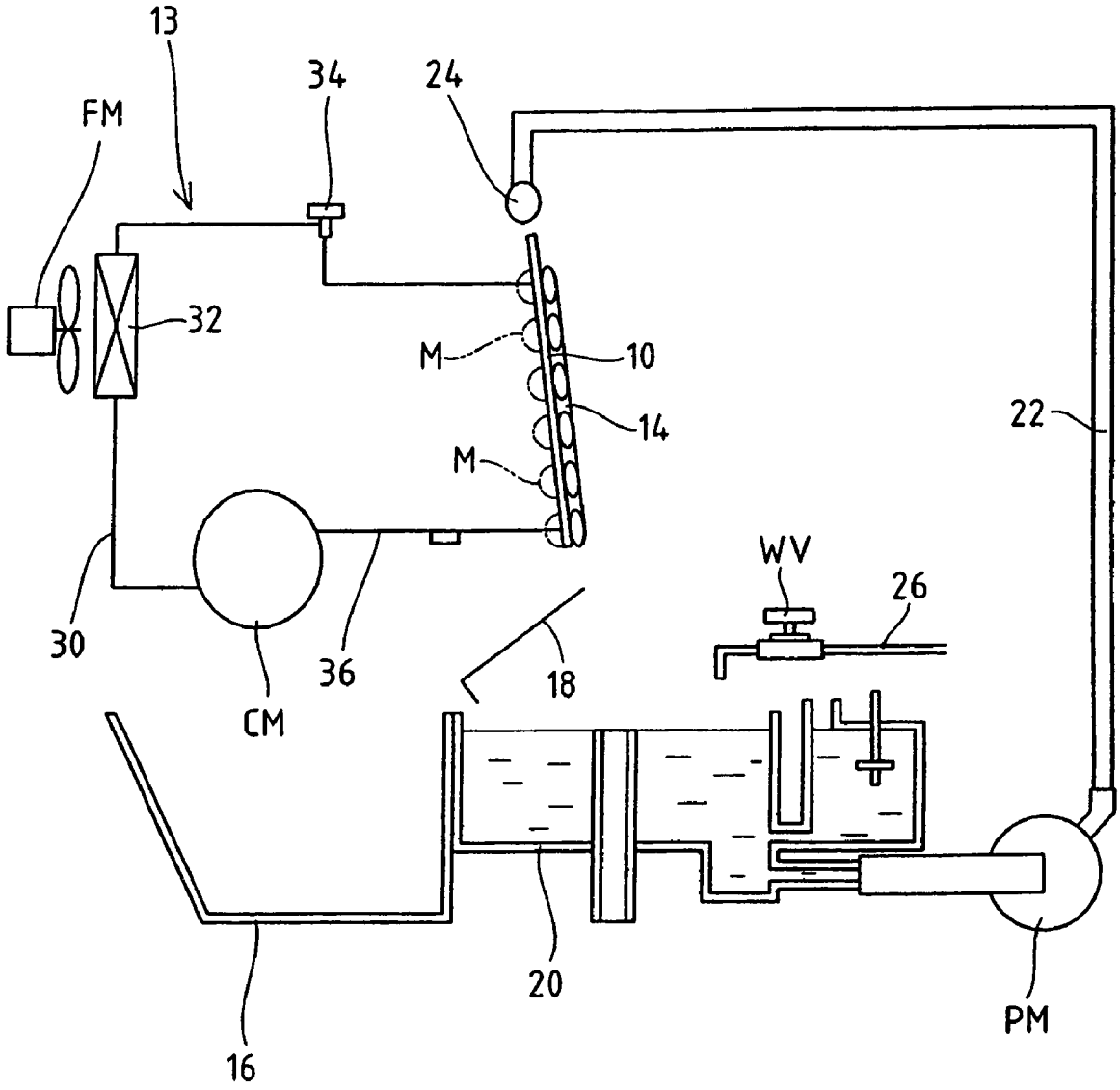
FIG. 1 is a schematic constitutional diagram of an automatic ice making machine of the stream down type according to an Example of the present invention.

FIG. 1 shows a schematic structure of an automatic ice making machine of the stream down type as an automatic ice making machine according to the Example. On the back surface of an ice making plate (ice making section) 10 approximately perpendicularly set in an ice making room, an evaporation pipe (evaporator) 14 meandering in a transverse direction led out from a refrigeration system 13 is tightly fixed so that a coolant is circulated so as to forcibly cool the ice making plate 10 during the ice making operation. Immediately below the ice making plate 10, a guide plate 18 for guiding an ice block M removed from the ice making plate 10 by melting by the deicing operation, to a stocker 16 provided obliquely downward, is provided in an oblique position. It should be noted that a large number of through holes (not shown) are bored through the guide plate 18 so that the ice making water supplied to the ice making surface (front surface) of the ice making plate 10 during the ice making operation is collected and retained in an ice making water tank 20 located downward through the through holes of the guide plate 18.

An ice making water supply pipe 22 led out from the ice making water tank 20 through a circulating pump PM is connected to an ice making water sprinkler 24 provided above the ice making plate 10. In the ice making water sprinkler 24, a large number of water sprinkling holes are bored so that the ice making water fed by pump pressure to the tank 20 during the ice making operation is sprinkled over to stream down to the ice making surface cooled up to a freezing temperature of the ice making plate 10 from the water sprinkling holes, thereby forming an ice block M of a prescribed shape on the ice making surface. It should be noted that, as shown in FIG. 1, above the ice making water tank 20, a water supply pipe 26 which appears connected to an external water supply, is configured so that a valve WV of the water supply pipe 26 is opened as required depending on the volume of water in the ice making water tank 20 decreasing during the ice making operation so as to retain a prescribed volume of ice making water in the ice making water tank 20.

As shown in FIG. 1, in the refrigeration system 13, the vaporized coolant compressed by a compressor CM is condensed and liquefied by a condenser 32 through a discharge pipe 30, being depressurized by an expansion valve 34. The vaporized coolant flows into the evaporation pipe 14, evaporates by sudden expansion therein, and exchanges heat with the ice making plate 10 thereby cooling the ice making plate 10 to below the freezing point. The vaporized coolant which has evaporated in the evaporation pipe 14 repeats the cycle of returning to the compressor CM through a suction pipe 36. It should be noted that reference character FM in the drawing denotes a cooling fan for the condenser 32.

Figure 2:
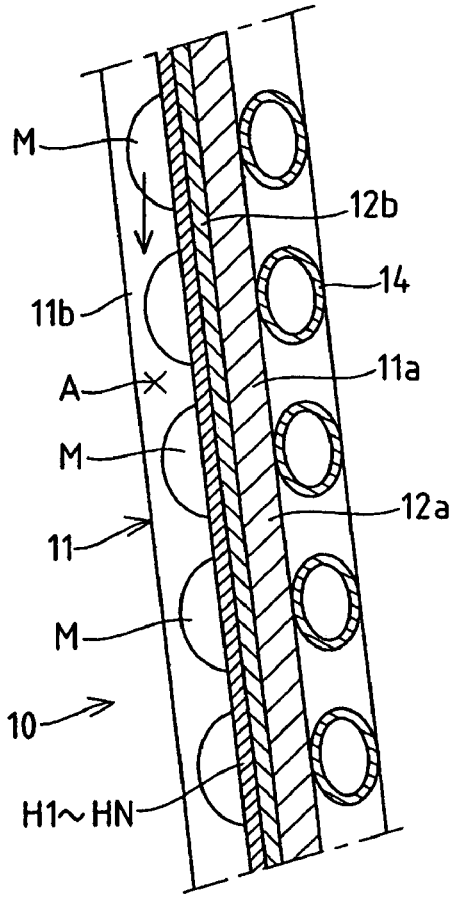
FIG. 2 is a longitudinal sectional side view showing an ice making section of the automatic ice making machine of the stream down type according to the Example.
Figure 3:
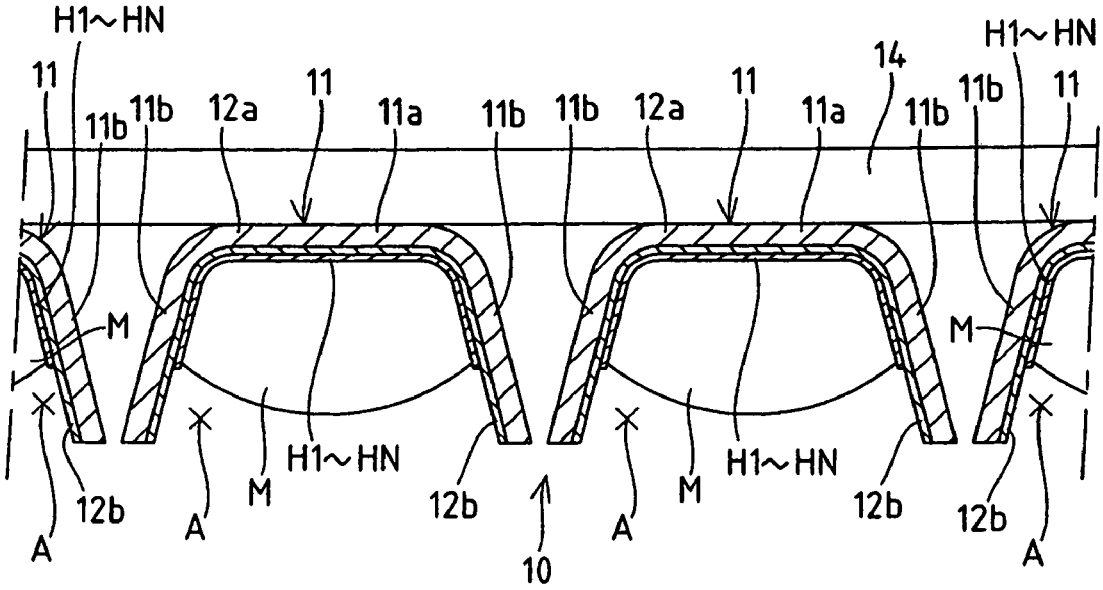
FIG. 3 is a cross-sectional plan view showing the ice making section of the automatic ice making machine of the stream down type according to the Example.

The ice making plate 10 is configured by arranging N numbers of ice making members 11 so as to be horizontally adjacent to each other (note that "N" is an integer equal to two or larger). Each of the ice making members 11, as shown in FIG. 2 or FIG. 3, is formed into generally U-shaped in transverse section, by a plate-like main body 11*a* vertically extending to a predetermined length, fixed to the evaporation pipe 14, and a pair of side plates 11*b*, 11*b* formed by bending toward the front (in a direction away from the evaporation pipe 14) on both sides in a direction of the width of the plate-like main body 11*a*. Specifically, an ice making area A for forming an ice block M is planned by the plate-like main body 11*a* and the side plates 11*b*, 11*b*. In this case, each of the ice making members 11 is set to incline forward at a predetermined angle from the lower part toward the upper part thereof. Also, both of the side plates 11*b*, 11*b* are bent to incline at a predetermined angle in the direction away from each other so that each of the ice making members 11 spreads outward gradually from the plate-like main body 11*a* toward the front end of each of the side plates 11*b*. Furthermore, the bent part between the plate-like main body 11*a* and each of the side plates 11*b* is formed into a rounded shape having a prescribed diameter.

Also, each of the ice making members 11 is configured by stacking a metal plate 12*a*, an insulating layer 12*b* and first to Nth heaters (heating means) H1 to HN composed of sheet metal in layers so that the heaters H1 to HN form the ice making surface. Each of the heaters H1 to HN is configured so that heat is generated by applying current so as to melt the frozen surface with the ice block M thereby dropping the ice block M due to its own weight. It should be noted that, in the Example, a stainless material (SUS304) having a thickness of 300 μm is employed for the metal plate 12*a*, a 25 μm thick polyimide film having thermal adhesiveness for the insulating layer 12*b*, and a 38 μm thick stainless material (SUS304) for the first to N the heaters H1 to HN.

In this case, each of the ice making members 11, in a state that the insulating layer 12*b* lies between the metal plate 12*a* and the heaters H1 to HN formed into a flat plate-like shape, is formed into a laminated body by bonding the metal plate 12*a* with the insulating layer 12*b*, and the insulating layer 12*b* with each of the heaters H1 to HN at high temperatures and pressures (for example, at 4MPa and 350° C.) respectively. It should be noted that, the pressure and temperature conditions employed when forming the laminated body are selected depending on the employed insulating layer 12*b* as appropriate. The laminated body is then formed by bending so as to form the plate-like main body 11*a* and the left and right side plates 11*b*, 11*b*, and subsequently, the evaporation pipe 14 is fixed to the back side of the plate-like main body 11*a* by soldering. Specifically, as shown in FIG. 2 or FIG. 3, in the ice making plate 10, each of the ice making members 11 is fixed to the evaporation pipe 14 so that the metal plate 12*a*, the insulating layer 12*b* and the heaters H1 to HN lie in this order from the evaporation pipe 14. Therefore, during the ice making operation, an ice block M is formed on the surface (ice making surface) of each of the heaters H1 to HN. It should be noted that the heaters H1 to HN have only to be formed in a minimal range required for forming an ice block M. Also, for means for fixing the evaporation pipe 14 to the metal plate 12*a*, not being limited to the above-mentioned soldering, the members 12*a*, 14 can be fixed to each other by various fixing means heretofore known accompanied by heating such as welding.

It should be noted that a material of the metal plate 12*a* or the heaters H1 to HN is not limited to the stainless material, and a metal such as copper, aluminum and iron, an alloy or the like can be selected as appropriate. Also, for the insulating layer 12*b*, not being limited to the above-mentioned polyimide film, a nonconductive resin material can be employed as appropriate. In this case, for the insulating layer 12*b*, a resin having thermal adhesiveness capable of bonding with the metal plate 12*a* or the heaters H1 to HN by thermocompression at high temperatures and pressures; having thermal resistance which does not produce degeneration at a temperature for fixing the evaporation pipe 14 to the metal plate 12*a* (in the Example, at a temperature for soldering the evaporation pipe 14, about 220° C.); formed into a film-like shape which does not interfere with the cooling of the heaters H1 to HN during the ice making operation, can be employed preferably. For example, for the insulating layer 12*b*, in addition to the above-mentioned polyimide, polyamideimide, polyetherimide, polyethersulphone, fluorine resins and the like can be employed preferably. It should be noted that, the allowable temperature limit of the insulating layer 12*b* is preferably 230° C. or higher, and more preferably 250° C. or higher.

Figure 4:
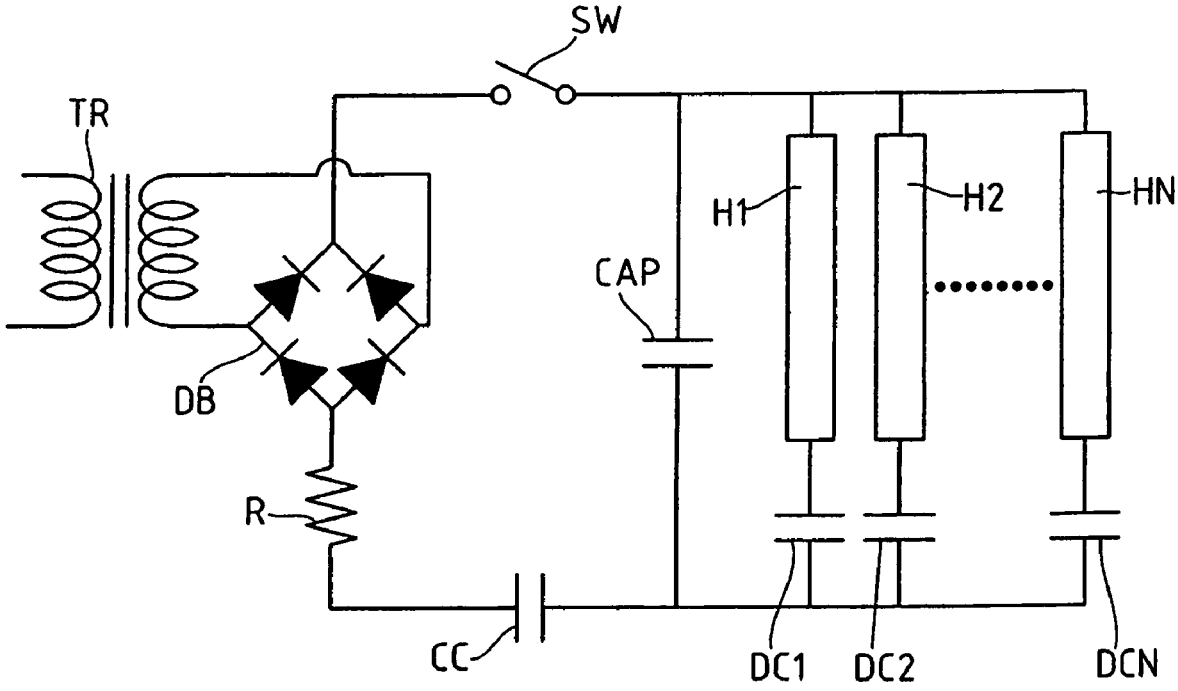
FIG. 4 is a schematic circuit diagram showing a control circuit of a heater of the automatic ice making machine of the stream down type according to the Example.

FIG. 4 shows a control circuit of the heaters H1 to HN of the automatic ice making machine of the stream down type according to the Example, which is configured so that the alternating current supplied from a power source is transformed to a required voltage by a transformer TR and then further converted to a direct current by a diode bridge DB. A switch SW, a resistor R and a charging contactor CC are connected to the diode bridge DB in series, and a capacitor CAP lies between the switch SW and the charging contactor CC. Also, between the switch SW and the charging contactor CC, a first heater H1 connected to a first discharging contactor DC1 in series, a second heater H2 connected to a second discharging contactor DC2 in series, and an Nth heater HN connected to an Nth discharging contactor DCN in series are connected in parallel with the capacitor CAP respectively. Specifically, by closing the first to Nth discharging contactors DC1 to DCN, a current is applied through the corresponding first to Nth heaters H1 to HN so as to generate heat. It should be noted that various conventional switches heretofore known such as a rotary switch and semiconductor switch can be employed for the switch SW.

In this case, each of the first to Nth heaters H1 to HN, which is arranged in each of the above-mentioned N numbers of ice making members 11 independently, can heat only the corresponding ice making member 11 by applying current through each of the heaters H1 to HN. It should be noted that since the insulating layer 12*b* is provided between the metal plate 12*a* and each of the heaters H1 to HN in each of the ice making members 11, no current is applied through the metal plate 12*a* or the other heaters H1 to HN when applying current through a given heater H1 to HN.

Specifically, the switch SW is powered on and the charging contactor CC is closed in a state that the first to Nth discharging contactors DC1 to DCN are opened, so as to charge the capacitor CAP. Then, in a state that the charging contactor CC is opened, by closing only any one of the first to Nth discharging contactors DC1 to DCN, the capacitor CAP discharges so as to apply current through the corresponding first to Nth heaters H1 to HN thereby generating heat in the relevant heaters H1 to HN. Therefore, by repeating the process successively in which one selected from the discharging contactors DC1 to DCN is closed so as to apply current through the corresponding heaters H1 to HN every time the capacitor CAP is charged, deicing is performed for each ice making member 11 (ice making area A) provided in the ice making plate 10.

[Action of Example]

Next, a description is given for action of the above-mentioned automatic ice making machine according to Example.

The ice making plate 10 of the automatic ice making machine of the stream down type according to Example is in a state that the insulating layer 12*b* lies between the metal plate 12*a* and the heaters H1 to HN, is formed by bonding the insulating layer 12*b*, the metal plate 12*a* and the heaters H1 to HN by thermocompression at high temperatures and pressures. Since the metal plate 12*a*, the insulating layer 12*b* and each of the heaters H1 to HN are thus laminated without using any adhesive, the heat generated for applying current through the heaters H1 to HN does not produce adhesive degeneration which causes the deterioration of the attachment between the metal plate 12*a*, the insulating layer 12*b* and the heaters H1 to HN, the peeling the heaters H1 to HN or the metal plate 12*a* off the insulating layer 12*b* is prevented. Therefore, the air layer is prevented from lying between the metal plate 12*a* and the insulating layer 12*b*, and between the insulating layer 12*b* and the heaters H1 to HN, thereby decreasing the cooling efficiency of the heaters H1 to HN for forming an ice block M, so that an stable ice making operation can be performed.

Incidentally, if fixing the evaporation pipe 14 to the metal plate 12*a* bent into U-shaped in cross section by soldering and then bonding the metal plate 12*a*, the insulating layer 12*b* and each of the heaters H1 to HN by thermocompression, since bonded at high temperatures and pressures as described above, soldering is impossible because molten solder separates the evaporation pipe 14 from the metal plate 12*a* or produces deformations or the like. In contrast, in this Example, since the ice making member 11 obtained by bonding the metal plate 12*a*, the insulating layer 12*b* and each of the heaters H1 to HN by thermocompression is formed by bending, and the evaporation pipe 14 is then fixed to the metal plate 12*a* by soldering, molten solder neither separates the evaporation pipe 14 nor produces deformations or the like. In this case, since polyimide which does not degenerate at a high temperature required by the insulating layer 12*b* for soldering (about 220° C.) is employed, even if fixing the evaporation pipe 14 to the ice making member 11 by soldering after forming the ice making member 11 into a laminated body, neither the insulating layer 12*b* nor the heaters H1 to HN peel off the metal plate 12*a* thereby forming no gap interfering with the ice making operation, in each of the members 12*a*, 12*b* and H1 to HN.

When starting the ice making operation of the automatic ice making machine of the stream down type according to this Example, each of the ice making members 11 (ice making plates 10) are forcibly cooled by the heat exchange with the coolant circulating through the evaporation pipe 14. The ice making water supplied from the ice making water tank 20 through the circulating pump PM to the plate-like main body 11*a* (heaters H1 to HN) of the ice making member 11 gradually starts freezing. In this case, since the ice making water streams down to the surface (ice making surface) of the first to Nth heaters H1 to HN of each of the ice making members 11, the ice making water freezes on the surface of each of the heaters H1 to HN thereby forming an ice block M. It should be noted that the ice making water dropping from the ice making surface without freezing is collected in the ice making water tank 20 through the through holes of the guide plate 18 and then supplied to the ice making plate 10 again.

When ice making completion detecting means (not shown) detects the completion of the ice making, the ice making operation is stopped so as to start the deicing operation. Shifting to the deicing operation, the switch SW is closed and the charging contactor CC is also closed in the control circuit, thereby charging the capacitor CAP. When the capacitor CAP is charged up to a prescribed voltage, the charging contactor CC is opened. Next, the first discharging contactor DC1 is closed, and the electricity charged in the capacitor CAP is applied through the first heater H1, thereby generating heat in the first heater H1. In this case, when closing the first discharging contactor DC1, the current charged in the capacitor CAP is suddenly applied through the first heater H1, thereby generating heat in the heater H1 momentarily. As a result, the interface between the surface of the first heater H1 and the freezing ice block M melts down, thereby removing the ice block M due to its own weight so as to be retained in the stocker 16. In this case, in the Example, since the ice making member 11 is formed as a trilaminar structure of the metal plate 12*a*, the insulating layer 12*b* and the heaters H1 to HN, when applying current through the first heater H1 via the first discharging contactor DC1, current is applied through neither the metal plate 12*a* nor the other heaters H2 to HN. Therefore, when applying current through the first heater H1, only the ice block M which has frozen in the ice making area A (ice making member 11) corresponding to the first heater H1 is removed by melting while the ice block M which has frozen in another ice making area A is not removed by melting.

Subsequently, when deicing completion detecting means (not shown) detects that the ice block M has completely dropped from the ice making member 11 in the ice making area A corresponding to the first heater H1, the first discharging contactor DC1 is opened. If the temperature of the frozen surface between the ice making member 11 and the ice block M becomes 0° C. or higher, the ice block M is removed. Therefore, if means for detecting the temperature of the ice making surface is employed as the deicing completion detecting means, deicing can be controlled stably. Next, when the charging contactor CC is closed thereby charging the capacitor CAP again up to a prescribed voltage similarly to the above, the charging contactor CC is opened so as to complete the charging. Next, the second discharging contactor DC2 is closed; the electricity charged in the capacitor CAP is applied through the second heater H2 thereby heating the second heater H2 so as to remove the ice block M from the corresponding ice making area A by melting, in order to be retained in the stocker 16. The electricity charged in the capacitor CAP is thus applied and stopped the application successively up to the Nth heater HN. When the deicing completion detecting means detects that the ice block M is removed from the corresponding ice making area A, the deicing operation finishes, shifting to the ice making operation.

Thus, the ice making plate 10 is composed of a plurality of independent ice making members 11, in each of which an ice making area A is defined and the first to Nth heaters H1 to HN are independently provided for each ice making area A (ice making member 11). As a result, even when forming an ice block M in all the ice making members 11 simultaneously by the ice making operation, only the ice block M which has frozen in a specific ice making area A (ice making member 11) can be removed by melting. Specifically, heat is generated only in the heaters H1 to HN corresponding to a given ice making area A by applying current thereby removing the ice block M and subsequently, current is applied through the heaters H1 to HN corresponding to other ice making areas A successively. Therefore, the heat amount required for removing an ice block M from a single ice making area A by melting can be suppressed. Consequently, no special thermal resistance is required for components or the like of the heaters H1 to HN, the wiring and the discharging contactors DC1 to DCN, thereby reducing the cost of the ice making machine. Furthermore, heat is generated in each of the heaters H1 to HN by applying current so as to remove the ice block M by melting thereby reducing the deicing operation; thereby reducing the running cost since no deicing water is required; thereby increasing the production volume of an ice block M per unit time; and thereby improving the ice making capacity of the ice making machine.

Also, during the deicing operation, since heat is momentarily generated in each of the heaters H1 to HN so that only the interface between the ice block M and each of the heaters H1 to HN is melted, the ice block M can be removed from the ice making area A in a short time during deicing leaving its inside temperature to be low. Therefore, the ice block M can be retained in the stocker 16 leaving a low temperature. Incidentally, if deicing takes a long time, there is a risk of forming a deformed ice block M caused by the part other then the interface between the ice block M and the heaters H1 to HN melting down and refreezing in the stocker 16. In the automatic ice making machine of the stream down type in the Example, however, since only the interface with the ice block M melts down, such a problem can be prevented from occurring.

Incidentally, as described above, if an ice block M is removed from the ice making area A leaving its inside temperature low, there is a risk that the ice block M once removed from the surface of the ice making member 11 (heaters H1 to HN) might refreeze on the surface of the ice making member 11 (heaters H1 to HN) in the middle of dropping. Consequently, in the automatic ice making machine of the stream down type in this Example, since each of the ice making members 11 is set to incline forward from the lower part toward the upper part thereof, the ice block M once removed from the surface of the ice making member 11 (heaters H1 to HN) separates farther away from the ice making member 11 as it drops away, thereby preventing the ice block M from freezing on the surface of the ice making member 11 (heaters H1 to HN). Also, since both of the side plates 11*b*, 11*b* of each of the ice making members 11 are configured so as to spread outward gradually toward the front, the ice block M also separates farther away from each of the side plates 11*b*, 11*b* as it drops away, thereby preventing the ice block M from freezing on the side plates 11*b*, 11*b*. Furthermore, since the bent part between the side plates 11*b*, 11*b* and the plate-like main body 11*a* is formed into a rounded shape, when the interface of the ice block M melts down, the ice block M can be removed from the surface of the ice making member 11 (heaters H1 to HN) quickly.

[Modification Example]

Figure 5:
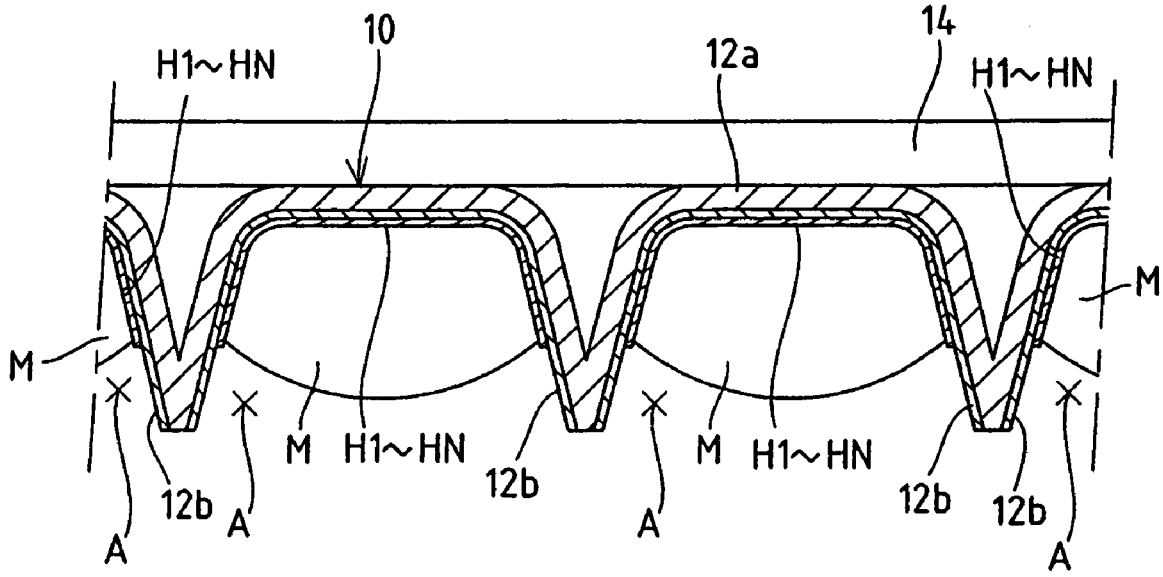
FIG. 5 is a cross-sectional plan view showing an ice making section of an automatic ice making machine of the stream down type according to a modification example, wherein (a) shows a case in which an ice making section composed of a single plate member is formed by bending a plurality of times, planning a plurality of ice making areas, and (b) shows a case in which a wall member is provided standing on the plate member, planning a plurality of ice making areas.
Figure 5:
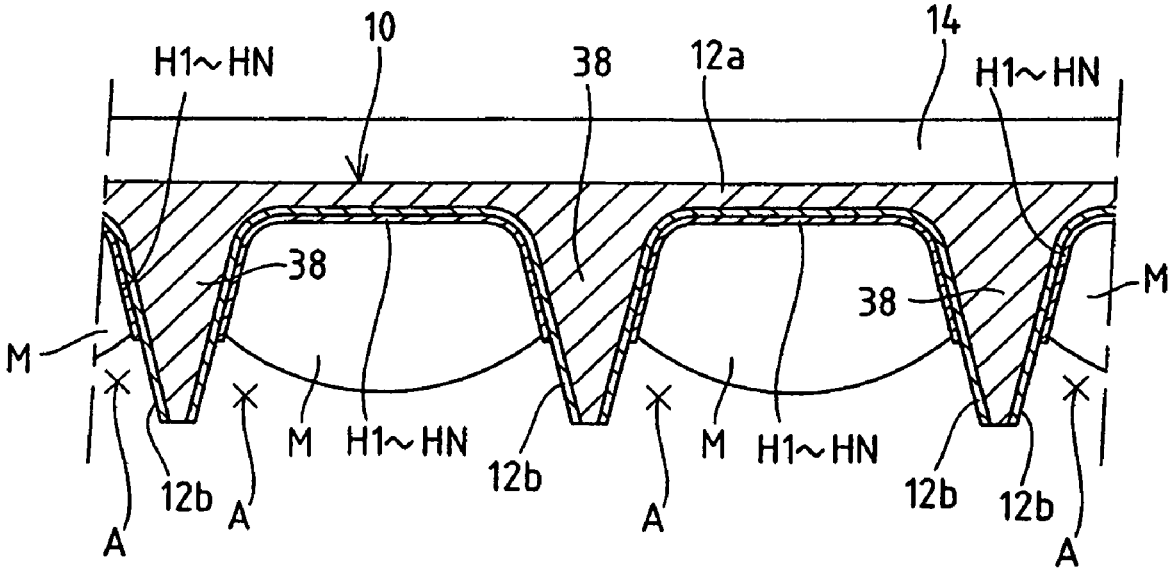

It should be noted that the automatic ice making machine according to the present invention is not limited to that in the Example described above, but various modifications are applicable. For example, the Example is configured so that an ice block is removed from a single ice making member and another ice block is then removed from a next ice making member. However, with a plurality of ice making members as one unit of ice making area, an ice block can be removed by the unit. Also, although the heating means provided for each ice making area is individually controlled for applying current and stopping current application in the Example, by controlling applying current and stopping current application over the heating means on a given group basis, the ice block in the ice making area corresponding to the heating means through which current application is controlled can also be removed by melting. Subsequently, although the ice making section is composed of a plurality of ice making members, in each of which an ice making area is defined in the Example, an ice making section 10 composed of a single plate member may be formed by bending a plurality of times so as to provide a plurality of ice making areas A as shown in FIG. 5(*a*), or a plurality of wall members 38 may be provided standing on the ice making section 10 composed of a plate member in the width direction at an interval in parallel so as to provide a plurality of ice making areas A thereby providing heating means H1 to HN independently in each ice making area A as shown in FIG. 5(*b*).

Also, in the Example, during the deicing operation, an ice block is removed from one ice making area and an ice block is then removed from another ice making area so that an ice block is removed from all the ice making areas and then shifting to the ice making operation. However, an ice block may be formed in ice making areas in order from the area where deicing has finished. Furthermore, the ice making section may be configured so as to be visually recognized from outside. In this case, the ice making section is advantageous in that an attractive display can be shown, by giving a wonderful contradictoriness between the ice making operation and the deicing operation to be performed at the same time to an observer observing the ice making section, and by gaining the observer's favor by showing that an ice block is removed in a given order. In this case, if controlling randomly the heating means through which current is applied, since an ice block is randomly removed from the ice making section, the observer pays strong attention to the next ice block to be removed.

It should be noted that although the ice making section is configured so as to incline forward at a predetermined angle in the ice making machine of the Example, the ice making section can be perpendicularly arranged. In this case, the time for applying current through the heating means is set to be longer so that the ice block which has once removed from the ice making section might not refreeze in the ice making section in the middle of dropping. Also, due to the similar reason, the present invention is not limited to the configuration in which the plate-like main body and side plate of the ice making section spread outward toward the front end, or the configuration in which the bent part between the plate-like main body and the side plate is formed into a rounded shape having a prescribed diameter. It should be noted that the automatic ice making machine of the stream down type has been given as an automatic ice making machine for carrying out the present invention, but the present invention is not limited to this. A type in which ice making water is supplied to an ice making cell defined in the ice making section so as to form an ice block is also applicable. Various conventional automatic ice making machines heretofore known are also applicable as long as configured so that a plurality of ice making areas are provided in the ice making section and heating means is provided independently in each ice making area.

Figure 6:
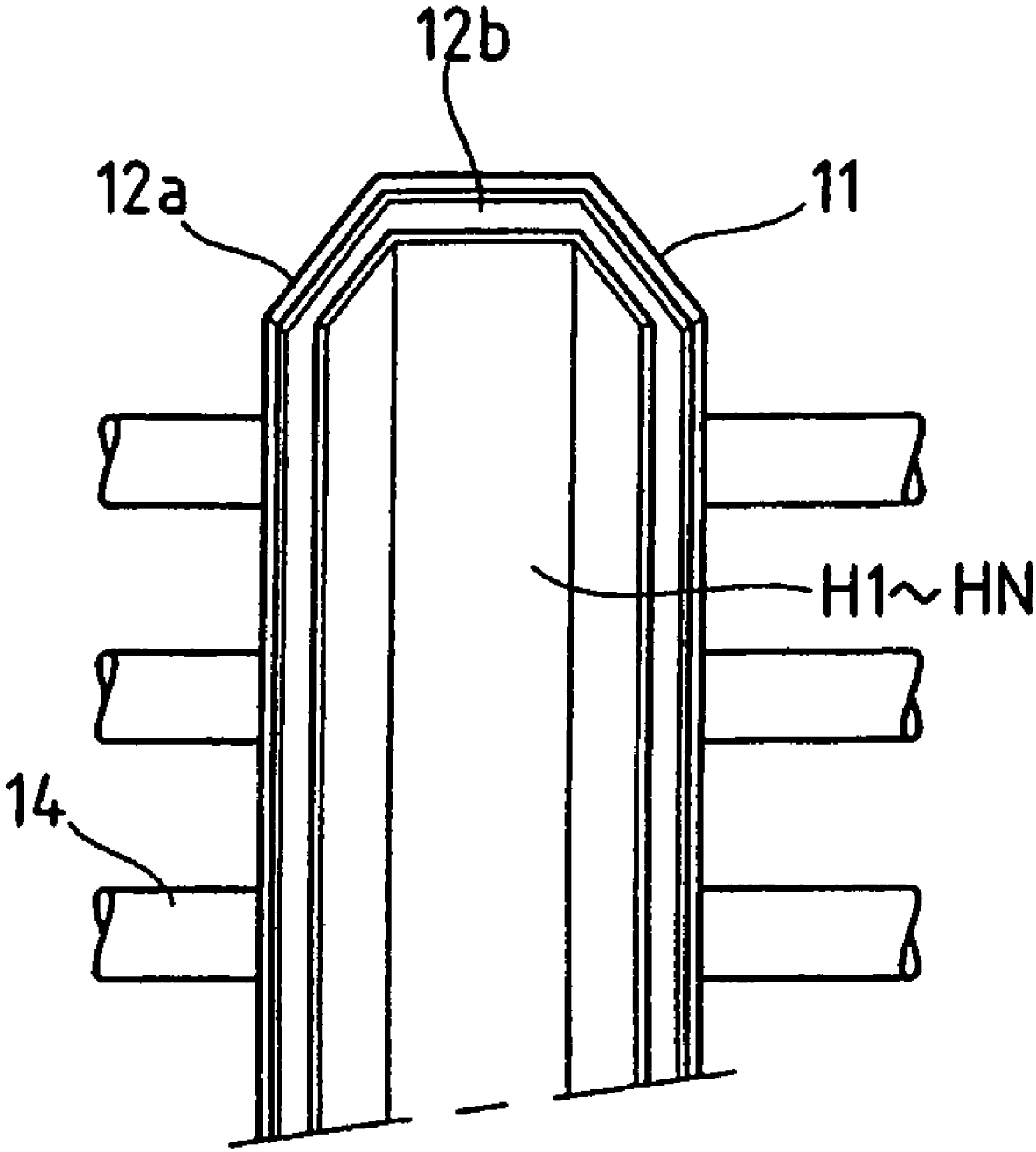
FIG. 6 is a front view showing the ice making section of the automatic ice making machine of the stream down type according to the Example.

An Example of an automatic ice making machine according to another invention of the present application is shown in FIG. 6. For example, in the automatic ice making machine shown in FIG. 1 to FIG. 3, after laminating the metal plate 12*a*, the insulating layer 12*b* and each of the heaters H1 to HN, a process is made so that a prescribed range of the peripheral edge part of the heaters H1 to HN is eliminated by etching or the like. Specifically, as shown in FIG. 6, the external outline of the heaters H1 to HN is set to be located inside the external outline of the insulating layer 12*b* so that the insulating layer 12*b* is exposed in the outer peripheral part of the heaters H1 to HN.

Also in this case, since the forming area of the heaters H1 to HN is set to be located inside the forming area of the insulating layer 12*b* and the end edge of the heaters H1 to HN is configured so as not to make contact with the metal plate 12*a*, the metal plate 12*a* or the like is reliably prevented from being current-applied when applying current through the heaters H1 to HN.

Also, a smaller forming area of the heaters H1 to HN increases the resistance value thereby increasing the heat value of the heaters H1 to HN, an ice block M can be removed efficiently by melting.

Also, the forming area of the heating means has only to be set to be smaller than the forming area of the insulating layer. The shape and size of the forming area of the heating means are not limited to those in the Example, and it is only necessary to form the heating means at least in the forming region of an ice block in the ice making section. Specifically, if the heating means is formed only in the area to which ice making water streams down during the ice making operation (for example, the forming area of the heating means is made smaller than the area to which ice making water streams down), the ice block formed during the deicing operation can be removed reliably. Furthermore, there is a risk that the region of the heating means in which no ice block is formed might not be cooled when generating heat in the heating means by applying current thereby reaching an abnormally high temperature, but such a problem does not occur by forming the heating means only in the forming region of an ice block.

The invention claimed is:

1. An automatic ice making machine which comprises an evaporator (14) and electric heating means (H1 to HN) in an ice making section (10), configured so that a coolant is circulatingly supplied through said evaporator (14) so as to cool said ice making section (10) and ice making water is supplied to the ice making section (10) so as to form an ice block (M) during ice making operation while heat is generated in said heating means (H1 to HN) by applying current so as to remove the ice block (M) from said ice making section (10) by melting during deicing operation, wherein said ice making section (10) is configured by arranging a plurality of vertically extending ice making members (11) ibso that the ice making members are horizontally adjacent to each other;

each of said ice making members (11) is composed of a metal plate (12*a*) to which said evaporator (14) is fixed, the heating means (H1 to HN),and an insulating layer (12*b*) lying between the metal plate (12*a*) and the heating means (H1 to HN) such that said metal plate (12*a*), heating means (H1 to HN) and insulating layer (12*b*) are provided in layers, thus forming an ice making area (A) which is formed in generally U-shaned in transverse section and vertically extends; and an external outline of said heating means (H1 to HN) is configured so as to be located inside an external outline of said insulating layer (12*b*), and said heating means (H1 to HN) are provided only in an area where ice making water streams down in said ice making area (A).

2. The automatic ice maker of claim 1, wherein said insulating layer (12*b*) comprises a thermoplastic for bonding said heating means (H1 to HN) and said metal plate (12*a*).

* * * * *